United States Patent [19]

Kikumoto

[11] Patent Number: 4,566,362

[45] Date of Patent: Jan. 28, 1986

[54] SYNCHRONIZING SIGNAL GENERATOR

[75] Inventor: Tadao Kikumoto, Osaka, Japan

[73] Assignee: Roland Corporation, Osaka, Japan

[21] Appl. No.: 629,561

[22] Filed: Jul. 10, 1984

[30] Foreign Application Priority Data

Jul. 14, 1983 [JP] Japan ..... 58-110067[U]

[51] Int. Cl.[4] ..... G10F 1/00

[52] U.S. Cl. ..... 84/1.03; 84/DIG. 12

[58] Field of Search ..... 84/1.01, 1.03, DIG. 12, 84/1.28, 1.24

[56] References Cited

U.S. PATENT DOCUMENTS

| | | | |
|---|---|---|---|
| 4,419,918 | 12/1983 | Dyck et al. | 84/1.28 |
| 4,448,104 | 5/1984 | Hoshii | 84/1.28 |
| 4,454,796 | 6/1984 | Inoue et al. | 84/1.03 |
| 4,491,049 | 1/1985 | Mizuta et al. | 84/1.28 |

*Primary Examiner*—Forester W. Isen

*Attorney, Agent, or Firm*—W. G. Fasse; D. H. Kane, Jr.

[57] ABSTRACT

A synchronizing signal generator generates synchronizing signals in synchronism with the performance of a musical piece even from an intermediate point of the musical piece. More specifically, upon actuation of a manual switch (102) in accordance with a musical piece, a code signal corresponding to a beat number is recorded in a tape recorder (200). At the same time, a clock counter (112) counts clock pulses during a period of time from the point where a code signal corresponding to the beat number is received to the point where the next succeeding code signal is received. A CPU (105) divides a count value of the clock counter by a predetermined numerical value so that a value obtained by the division is stored in a memory (114). When the recorded code signal is reproduced and applied to an input terminal (101), the CPU identifies a beat number from the reproduced code signal and delivers a step number signal corresponding to the beat number and a sequencer start signal to a sequencer (300). During a period of time from an identification of a beat number to the identification of the next succeeding beat number, the clock counter counts clock pulses and the CPU provides synchronizing signals when a count value of the clock counter becomes equal to the value stored in the memory.

5 Claims, 10 Drawing Figures

SYNCHRONIZING SIGNAL GENERATOR

BACKGROUND OF THE INVENTION

1. Field of the Invention

The present invention relates to a synchronizing signal generator. More particularly, the present invention relates to a synchronizing signal generator for generating synchronizing signals necessary for the generation of musical tone signals through the use of a music synthesizer for example.

2. Description of the Prior Art

In the past, the applicant of the present invention obtained U.S. Pat. No. 4,419,918 for another invention entitled "Synchronizing Signal Generator and an Electronic Musical Instrument Using the Same". The earlier patented invention serves effectively as means for removing a monotonous and too mechanical impression of the tempo in case where an automatic rhythm generator is used for a rhythm part in multiplex recording. More specifically, the prior invention operates an automatic rhythm generator in synchronism with the performance already recorded. In the prior invention, pulse signals are generated at arbitrary intervals by manual operation of a switch or the like and these pulse signals are recorded in a magnetic tape, so that an automatic rhythm gererator is actuated according to the signals synchronizing with the reproduced pulse signals.

However, the prior invention does not contain any data concerning the playing order and accordingly, though synchronizing signals can be generated from the beginning of the play of a musical piece, synchronizing signals cannot be generated from an intermediate point of a musical piece or at the time when the play of a musical piece comes to a measure specified in an arbitrary manner. As a result, not a little inconvenience occurs at the time of multiplex recording. In addition, synchronizing signals cannot be generated from an arbitrarily selected point while a recording tape is moving.

SUMMARY OF THE INVENTION

Therefore, a primary object of the present invention is to provide a synchronizing signal generator capable of generating synchronizing signals even from an arbitrarily selected intermediate point of a musical piece.

Briefly stated, according to the present invention, instructions are manually given to generate successively code signals representing points on the score of a musical piece and the interval of the code signals is counted according to clock signals and then a, calculation is performed based on the count value and a predetermined calculation formula so that the result of the calculation is stored. Then, the stored result of the calculation is read out whereby synchronizing signals are delivered when clock signals are counted to the number corresponding to the result of the calculation.

Therefore, according to the present invention, by manual operation for giving instructions at the time of listening to a live performance of a musical piece, code signals representing the selected points on the score of the musical piece are recorded together with the musical piece in a magnetic tape recorder for example, and if the code signals are reproduced, synchronizing signals accompanied with arbitrary delicate, non-mechanical variations can be generated in synchronism with the reproduction of the recorded musical piece. Furthermore, since a synchronous performance can be started from an arbitrary point of a musical piece, special performance effects such as partial modifications or synchronization with a visual image can be easily achieved.

In addition, in a preferred embodiment of the present invention, designating means for arbitrarily designating an absolute position or point on the score of a musical piece to be played is provided so that code signals are generated from the designated point on the score. Accordingly, in this preferred embodiment of the invention, if an absolute point on the score, for example, the 18th beat is arbitrarily designated, synchronizing signals can be generated after the sound of the 18th beat in the musical piece is reproduced by a magnetic tape recorder.

In this preferred embodiment of the present invention, a code signal representing a point on the score is converted into a signal representing a step number of a sequencer which is to be applied to the sequencer. Accordingly, the sequencer is brought to the step based on the signal representing the step number and when a a signal is applied thereto, synchronous performance is started from said step.

These objects and other objects, features, aspects and advantages of the present invention will become more apparent from the following detailed description of the present invention when taken in conjunction with the accompanying drawings.

DESCRIPTION OF THE EMBODIMENTS

Figure 1:
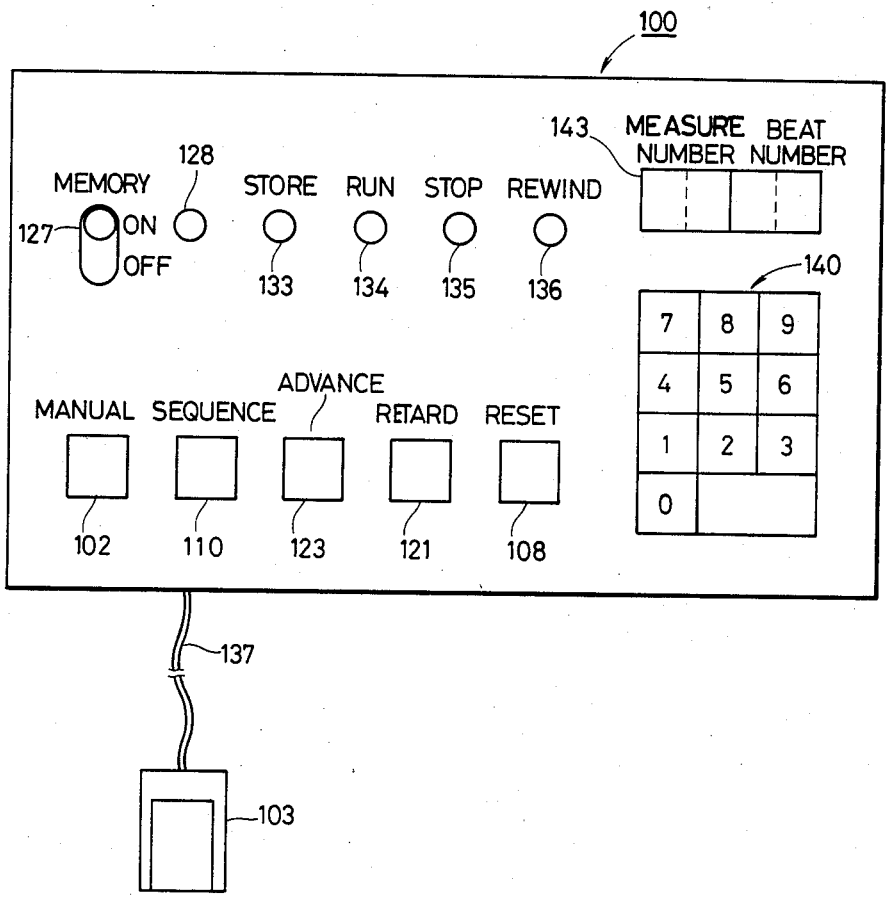
FIG. 1 is a view showing the outer appearance of an operational portion disposed on a panel in accordance with an embodiment of the present invention.

Referring to FIG. 1, the synchronizing signal generator 100 has an operating panel with a memory loading switch 127 to determine whether data is allowed to be stored in a memory 114 as described below with regard to FIG. 2. A light emitting diode 128 is provided to inform the operator that it becomes possible to store the data in the memory 114. A reset key 108 serves to place the synchronizing signal generator 100 into reset state. A manual switch 102 provides an instruction for generating pulses when the operator actuates the switch 102 while he is listening to sounds from a percussion instrument being actually played, as well as an instruction for generating codes representing measures and beat numbers on the score (hereinafter referred to as "measure number codes"). A foot switch 103 is provided to give an instruction for generating pulses and measure number codes when the operator holds an instrument with his hand and steps on the foot switch. The foot switch 103 is connected by connection wires 137 to the synchronizing signal generator 100.

A sequence switch 110 provides an instruction for proceeding to further steps when a CPU 105 as described below with regard to FIG. 2 executes an operation pursuant to a program. An advance switch 123 is actuated when it is desired to accelerate the tempo clock and a retard switch 121 is actuated when it is desired to decelerate the tempo clock.

In the operational portion, light emitting diodes 133 to 136 are further provided. The light emitting diodes 133 (as STORE display) indicates that a step is in process for giving an instruction for counting clock signals or for dividing numeral data with the CPU 105 or loading the numeral data resulting from the division into the memory 114. The light emitting diode 134 (as RUN display) indicates that the CPU 105 proceeds to a step for delivering output pulse signals. The light emitting diode 135 (as STOP display) indicates that the output pulse signals are inhibited from being delivered. The light emitting diode 136 (as REWIND display) indicates that the rewinding of the tape is requested after the memory 114 has been loaded.

Furthermore, a ten key 140 and a display 143 are provided in the operational portion. The ten key 140 is actuated to designate a measure number and a beat number on the score. The measure number and the beat number entered through the ten key 140 are represented on the display 143.

Figure 2:
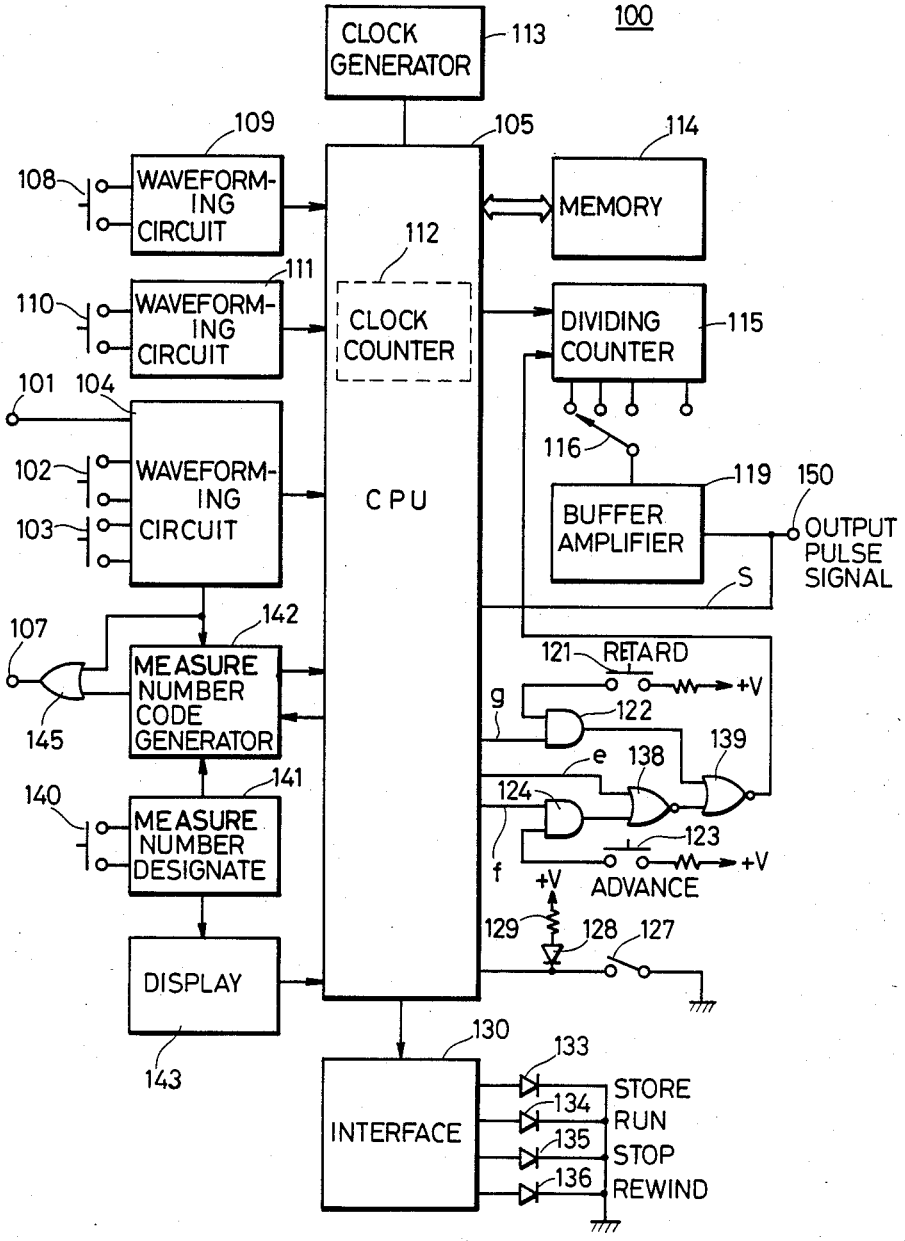
FIG. 2 is a schematic block diagram of an embodiment of the present invention.

Referring to FIG. 2, the structure of the synchronizing generator 100 will be described. An audio signal input terminal 101 is connected to receive from an external equipment such as a tape deck for example, pulse signals which define a rhythm tempo (referred to as "click signals" hereinafter). The click signals received are shaped by a waveforming circuit 104 and fed into the CPU 105. Both the manual switch 102 and the foot switch 103 described above with regard to FIG. 1 are connected to the waveforming circuit 104.

The waveforming circuit 104 not only shapes the above mentioned click signals received by the audio signal input terminal 101 but also produces click signals whenever a contact of the manual switch 102 or the foot switch 103 is closed. The click signals are fed to the CPU 105 and to a click signal output terminal 107 through an OR gate 145. The click signal output terminal 107 is connected to a record input terminal of the tape deck or the like. Accordingly, when the manual switch 102 or the foot switch 103 is actuated, the click signals can be recorded in the tape deck. The recorded click signals are reproduced and introduced as the rhythm tempo defining signals through the audio signal input terminal 101.

The reset switch 108 is connected to a waveforming circuit 109. When the contact of the reset switch 108 is closed, the waveforming circuit 109 permits pulse signals of a given width to be supplied to the CPU 105 which in turn is ready to restore its first step. The sequence switch 110 is connected to a waveforming circuit 111. The waveforming circuit 111 generates a pulse signal and supplies the same to the CPU 105 whenever the contact of the sequence switch 110 is closed.

In association with the CPU 105, a clock oscillator 113 is connected for generating clock signals. In the CPU 105, a clock counter 112 is provided and the clock counter 112 counts clock signals generated by the clock oscillator 113. More specifically, the clock counter 112 counts clock signals to measure a length of time from the receipt of a click signal to the receipt of the next succeeding click signal whenever the manual switch 102 for example is actuated and click signals are fed from the waveforming circuit 104 to the CPU 105. Then, the CPU 105 stores the count value of the clock counter 112 in the memory 114, reads the stored count value to divide it by a predetermined value and stores again the result of the division in the memory 114.

A frequency dividing counter 115 divides at predetermined division ratios (for example, $\frac{1}{2}$ to 1/48) the output pulse signal provided from the CPU 105 for the development of tempo clock signals and has output terminals for delivering, respectively, 178 to 1/48 frequency division output signals. These output terminals are connected to a time base selector 116 which serves as a division ratio selector. To obtain a desired number of pulses, the time base selector 116 is actuated, by switching, to selectively provide any one of the different division output signals of the frequency dividing counter 115. The selected one of the division output signals from the time base selector 116 is fed to a buffer amplifier 119. The buffer amplifier 119 delivers at an output terminal 150, the division output signal (namely, the tempo clock signal ) selected through the time base selector 116 as its output pulse signal.

The retard switch 121 is connected to an input to an AND gate 122. The other input to the AND gate 122 receives a gate signal g from the CPU 105. This gate signal g functions to inhibit one of a plurality of pulse signals from the CPU 105 from being fed to the frequency dividing counter 115. Accordingly, when the retard switch 121 is closed, an OR gate 139 is closed only for the period of a single pulse.

The advance switch 123 is connected of an input to an AND gate 124. The other input of the AND gate 124 receives an addition pulse signal f from the CPU 105. The addition pulse signal f is delivered by the CPU 105 once during a length of time from the point where a particular one of the click signals is received by the CPU 105 to the point where the next succeeding click signal is received. As a result, if the advance switch 123 is placed in a closed contact position, then the AND gate 124 is opened to admit the addition pulse signal f into an OR gate 138. The addition pulse signal f is added through the OR gate 138, to the output pulse signal e from the CPU 105.

The ten key 140 shown in FIG. 1 is connected to a measure number designating circuit 141. The measure number designating circuit 141 supplies as key code signals the measure number and the beat number entered through the ten key 140 to a measure number code generating circuit 142. Upon receipt of the key code signals from the measure number designating circuit 141, the measure number code generating circuit 142 generates as measure code signals, pulse signals corresponding to the measure number and the beat number in a predetermined form, and supplies these pulse signals not only to the CPU 105 beat, but also to an output terminal 107 through an OR gate 145. The measure number designating circuit 141 supplies the key code signals corresponding to the measure number and the beat number to the display 143 so that the designated measure number and beat number are represented on the display 143.

The memory loading switch 127 has a common contact grounded and an ON contact connected to the CPU 105 and a power supply +V through a series circuit of the light emitting diode 128 and a resistor 129. The CPU 105 is programmed to permit the rewriting of data in the memory 114 when the memory loading switch 127 is turned to the ON side to supply the CPU 105 with a low level signal. An interface 130 enables and disables the light emitting diodes 133 to 136 in response to the instruction signals from the CPU 105.

Figure 3:
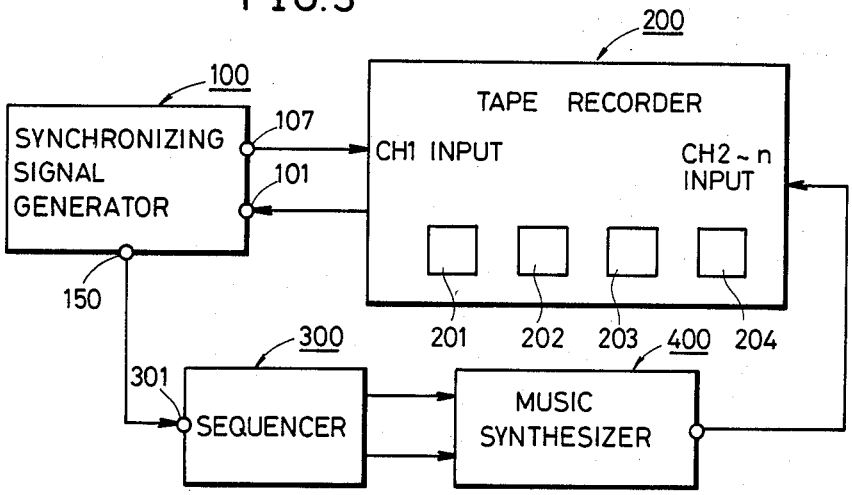
FIG. 3 is a schematic block diagram illustrating an example of an apparatus for enabling a music synthesizer to produce sounds through the utilization of a synchronizing signal generator as shown in FIG. 2.

FIG. 3 is a schematic block diagram of an arrangement for enabling a music synthesizer 400 to carry out an automatic play using the synchronizing signal generator 100 shown in FIGS. 1 and 2. The output terminal 107 of the synchronizing signal generator 100 of FIG. 2 is connected to a first channel record signal input terminal of the tape deck 200. A reproduction signal output terminal of the tape deck 200 is connected to the audio signal input terminal 101 of the synchronizing signal generator 100. Further, an output terminal 150 of the synchronizing generator 100 is connected to a synchronizing signal input terminal 301 of the sequencer 300. An output signal from the sequencer 300 is supplied to the music synthesizer 400.

The above described sequencer 300 and music synthesizer 400 are of well known construction conventionally utilized in automatic playing.

When the output pulse signals from the synchronizing generator 100 are received by the synchronizing signal input terminal 301 of the sequencer 300, the sequencer 300 operates in synchronism with the tempo of the received output pulse signals to supply, to the control signal input terminal of the music synthesizer 400, control signals based on the sound data preset in the sequencer 300, for example, data on the pitch, the volume, the length of sound, and the like. In response to the above described input control signals, the music synthesizer 400 generates and delivers tone signals from an output terminal 401. The tone signals are supplied to any one of the second to (n)th channel record signal input terminals of the tape deck 200. Instead of the tape deck 200, a video tape recorder may be used.

Now, referring to FIGS. 1 to 5B, the operation of this embodiment of the present invention will now be described. First, the operator actuates the reset switch 108 and in step SP1 (shown merely as SP1 in FIG. 5A), he actuates the sequence switch 110 and the CPU 105 proceeds to the first step. After that, the memory loading switch 127 is turned to the ON side in step SP2. Then, when data of the first measure and the first beat are entered by means of the ten-key 140 shown in FIG. 1, the measure number designating circuit 141 generates a corresponding key code signal to supply the same to the measure number code generating circuit 142 and to the display 143. Consequently, the display 143 indicates the first measure and the first beat. As a result of actuation of the sequence switch 110, the CPU 105 energizes the light emitting diode 133 reading "STORE" in step SP3.

Figure 4:
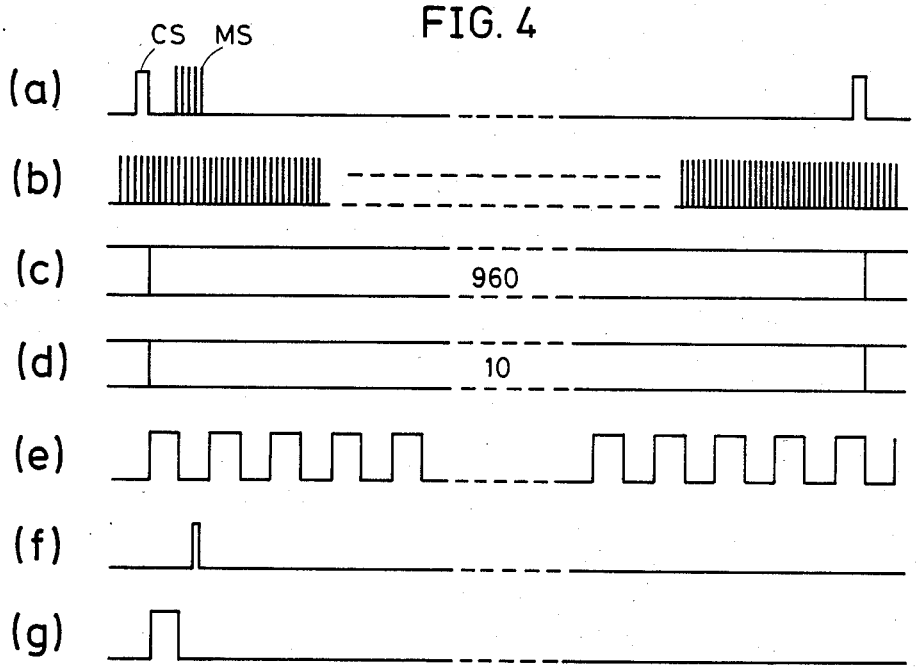
FIG. 4 is a waveform diagram of the signals in the components shown, in FIG. 2.
Figure 5A:
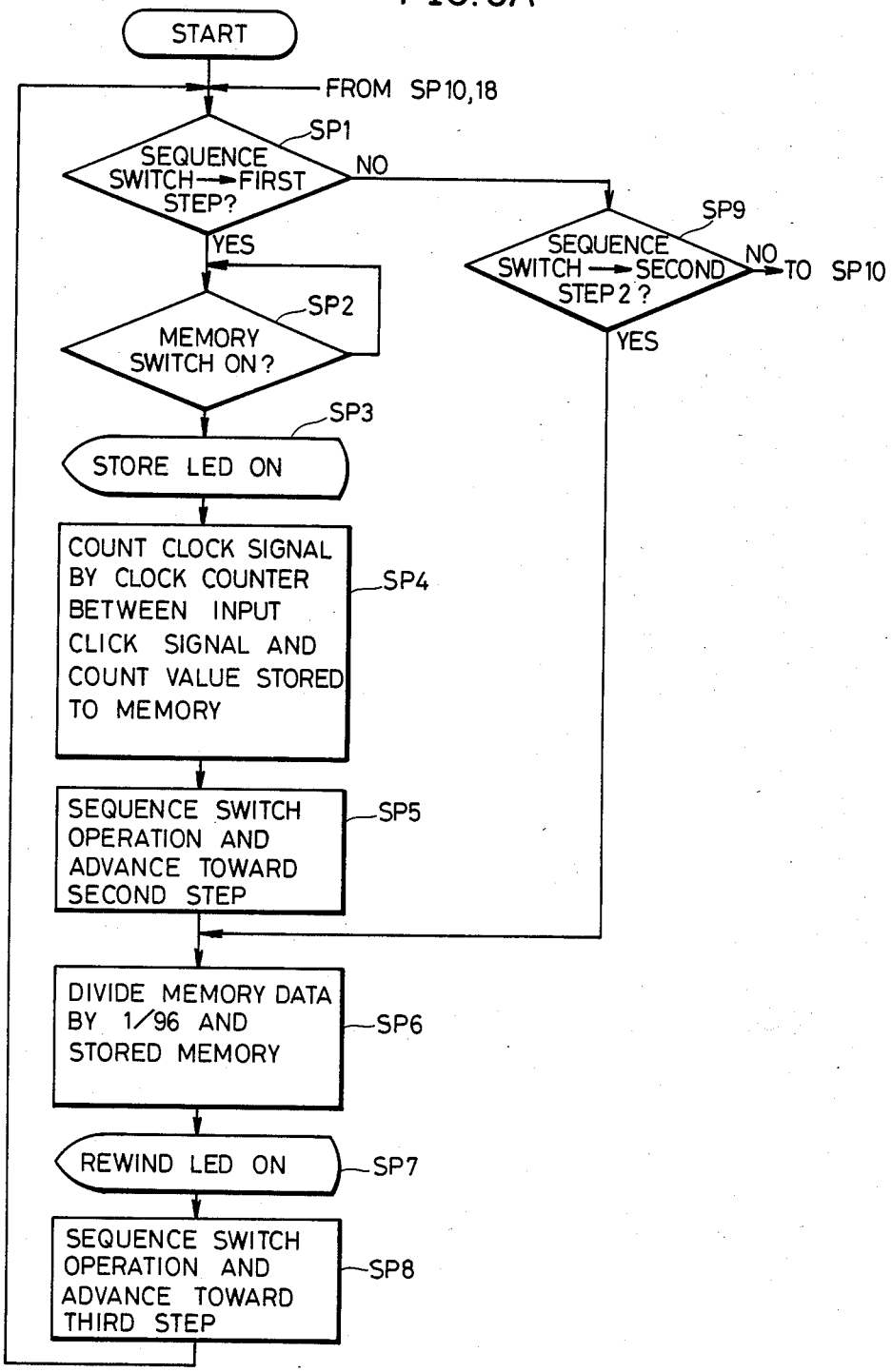
FIGS. 5A and 5B are flow charts for explaining the specific operation of an embodiment of the present invention.
Figure 5B:
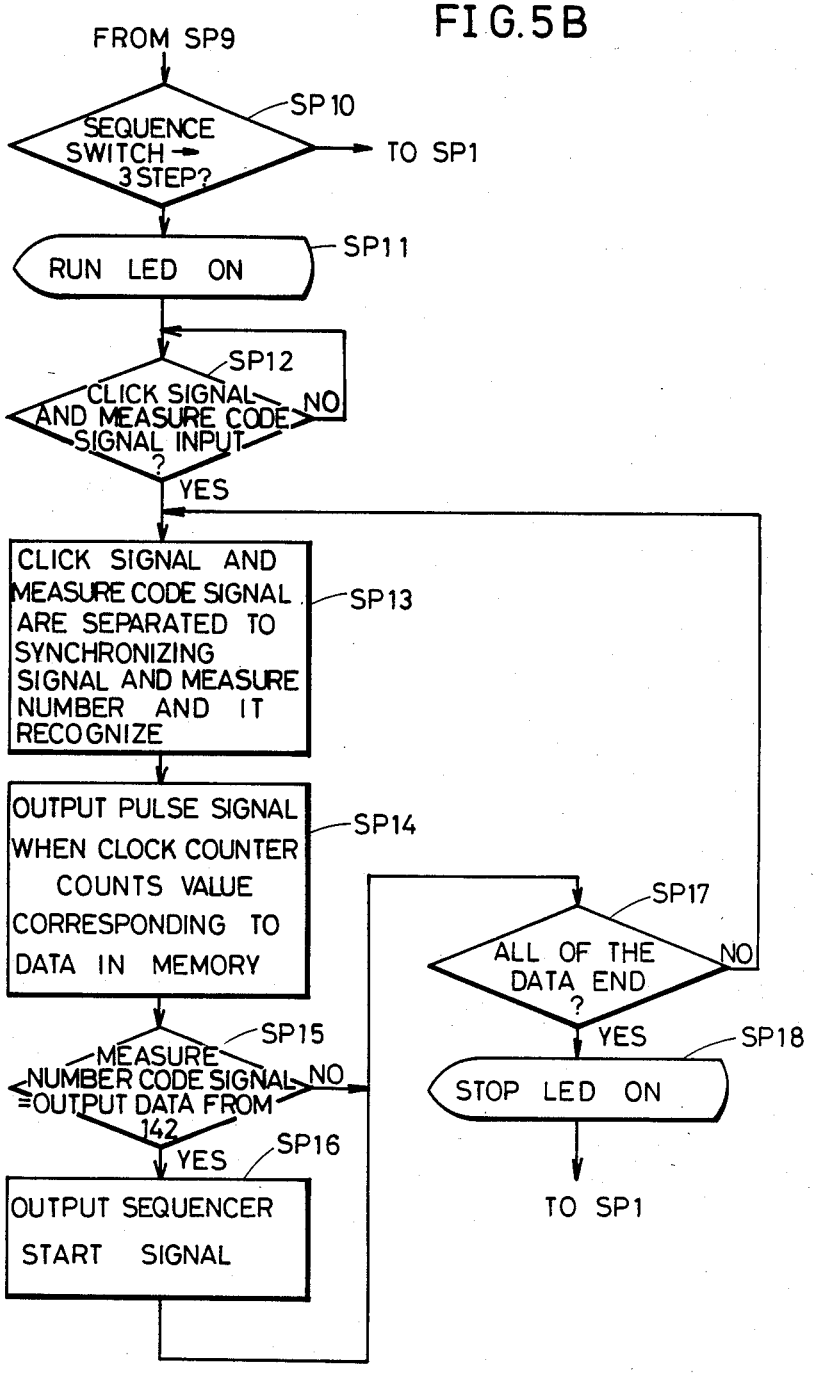

Under these circumstances, when the tape deck 200 is placed into record state and the manual switch 102 or from the foot switch 103 is actuated, the waveforming circuit 104 shapes the click signals from the manual switch 102 or from the foot switch 103 and provides the resultant signals as the click signals CS shown in FIG. 4(*a*) from the OR gate 145 to the first channel record signal input terminal of the tape deck 200 through the click signal output terminal 107.

The waveforming circuit 104 also delivers the above described click signals to the measure number code generating circuit 142. As a result, the measure number code generating circuit 142 supplies the preset data of the first measure and the first beat to the CPU 105 as well as to the tape deck 200 through the output terminal 107 from the OR gate 145. Based on the measure code of the first beat of the first measure received from the measure number code generating circuit 142, the CPU 105 renews the beat number and supplies the renewed number to the measure number code generating circuit 142 each time a click signal is supplied from the waveforming circuit 104. Accordingly, each time the manual switch 102 or the foot switch 103 is actuated, a click signals and a measure number code (MS in FIG. 4(*a*)) comprising the preset measure number and the successively renewed beat number are recorded in the first channel.

On the other hand, the CPU 105 in step SP4 causes the clock counter 112 to advance counting based on the clock pulses from the clock oscillator 113 each time a click signal is received. Then, the CPU 105 loads the memory 114 with a count value from the clock counter 112. Subsequently, in the same manner, actuation of the manual switch 102 or the foot switch 103 is continued till the rhythm part is completed. Then, the click signals as well as the measure number codes corresponding thereto are recorded in the first channel by the tape deck 200. On the other hand, each time a click signal is received, the memory 114 stores the count value of the clock counter 112 corresponding to the click signal.

When the rhythm part is thus completed, the sequence switch 110 is actuated in step SP5 and the CPU 105 proceeds to the second step. At this time, the CPU 105 turns on and off the light emitting diode 133 indicating "STORE". Then, the CPU 105 reads out the above described count values (shown in FIG. 4(*c*)) from the memory 114 and divides the count values by a predetermined value, for example, 96 (see FIG. 4(*d*)) in the step SP6. Subsequently, the CPU 105 reloads the memory 114 with a quotient of the division, for example 10. When the above described sequential operations are completed, the CPU 105 disables the light emitting diode 133 and then turns on the light emitting diode 136 indicating "REWIND" in the step SP7.

When the operator realizes that the light emitting diode 136 is lit, he sets the tape deck 200 to rewind the tape. In step SP8, the operator actuates the sequence switch 110 to cause the CPU 105 proceed to the third step. Then, in step SP10, the CPU 105 determines whether the program is made to proceed to the third step by the sequence switch 110. If the program is in the third step, the light emitting diode 136 is disabled in step SP11 and the light emitting diode 134 indicating "RUN" is turned on.

When the operator looks at the RUN display, he starts operating the tape deck 200. Consequently, click signals and measure number code signals are applied from the tape deck 200 to the input terminal 101. These click signals and measure number code signals are shaped into signals having a predetermined pulse width, by the waveforming circuit 104 so as to be fed to the CPU 105. The CPU 105 in step SP12 determines whether the click signal and the measure number code signal are received or not. After completion of this determination in the step SP12, the CPU 105 separates and identifies a click signal and a measure number code signal from the signal received in the step SP13. Then, in step SP14, the CPU 105 provides an output of the clock oscillator 113 to the clock counter 112 from the point where a click signal is identified so that counting is started. When a count value of the clock counter 112 becomes equal to the numerical value stored in the memory 114 in the above described second step, the CPU 105 delivers an output signal e. The clock counter 112 is reset in response to this output signal e. Thus, each time a count value of the clock counter 112 becomes equal to the numerical value stored in the memory 114, an output signal e is provided to reset the clock counter 112, and this operation is repeated till the next succeeding signal is applied. When the next succeeding click signal is applied, the above described sequential operations are started again.

The pulse signal e provided by the CPU 105 is applied to the frequency dividing counter 115 and a pulse signal (tempo signal) selected on a desired time base (according to the number of clock signals generated during one beat) is supplied as a synchronizing pulse signal to the sequencer 300 through the buffer amplifier 119 and the output terminal 150.

On the other hand, in step SP15, measure number code signals (shown as MS in FIG. 4(*a*)) separated and identified from the input signal are successively compared with the output of the measure number code generating circuit 142 by the CPU 105. When the output data (the data of the first measure and the first beat) from the measure number code generating circuit 142 are equal to the measure number and the beat number corresponding to the measure number code signal separated and identified as described above, the CPU 105 delivers a sequencer start signal s through the output terminal 150.

As described above, if the first measure and the first beat are preset in the third step in the CPU 105, synchronizing pulse signals and a sequencer start signal can be applied to the sequencer 300 from the start of the first beat of the first measure when a reproduction is made from the beginning in the tape deck 200 where the click signals and the measure number code signals are recorded. Accordingly, the music synthesizer 400 actuated by the sequencer 300 can also provide a synchronous play from the start of the first beat of the first measure.

In addition, if an intermediate point of a musical piece, the first beat of the third measure, for example, is preset by means of the ten key 140 prior to the third step, a start signal s is not provided in the third step after the tape deck 200 has been placed in the reproduction state till the measure number and the beat number identified by the CPU 105 become respectively the third measure and the first beat to be equal to the output data of the measure number code generating circuit 142. For this reason, the sequencer 300 receives synchronizing pulse signals to advance the program. However, since an actuation signal is not supplied from the sequencer 300 to the music synthesizer 400, the music synthesizer 400 does not start operation. Consequently, the program advances and when the content of the program corresponding to the first beat of the third measure is attained, the music synthesizer 400 starts operation. Thus, it becomes easy to add modifications and other effects to the play by designating a desired measure.

Accordingly, if it is desired to start a synchronous play from an intermediate point of a musical piece for the purpose of correcting an error or for any other reasons, the following operations need be done. After the sequence switch 110 is actuated to set the third step, a desired measure number and a desired beat number are entered through the ten key 140. Then, a measure number code signal corresponding thereto is generated by the measure number code generating circuit 142. Subsequently, when the tape deck 200 is placed into the reproduction state, the click signal and the measure number code signal are separated and identified in the same manner as described above. Then, sequencer actuating pulses are provided from the frequency dividing counter 115. If the measure number and the beat number identified by the CPU 105 are not equal to the preset measure number and beat number, a sequencer start signal s is not supplied. In consequence, the music synthesizer 400 does not operate though the sequence program of the sequencer 300 advances. Thus, reproduction of the recorded signals by the tape deck 200 goes on and when the measure number and the beat number identified by the CPU 105 become equal to the preset measure number and beat number, a sequencer start signal is delivered by the CPU 105. As a result, the sequencer 300 provides an instruction for playing by the music synthesizer 400 so that a synchronous play is started from a desired point of the musical piece.

Instead of presetting the measure number, the measure number may be indicated on the display 143 so that looking at the indication, the operator can actuate manually the sequencer 300 and the music synthesizer 400 from an arbitrary point after operation of a fast forward key 201 of the tape deck 200 as required.

In the above described embodiment, synchronizing signals cannot be generated in synchronism with the musical piece unless the click signals and the measure number code signals recorded in the tape deck 200 are reproduced from the beginning. In other words, according to the above described embodiment, in order to generate synchronizing signals from the start of a specified measure of a musical piece in the course of a performance, it is necessary to designate the measure number and the beat number and to reproduce the recorded click signals and measure number code signals from the beginning, and synchronizing signals cannot be generated when a reproduction is made from an arbitrary point of the performance after operation of a fast forward of the tape deck 200. Therefore, the following description relates to an embodiment wherein synchronizing signals can be generated even if a reproduction is made from a specified point of the performance or from a specified position on a score.

Figure 6:
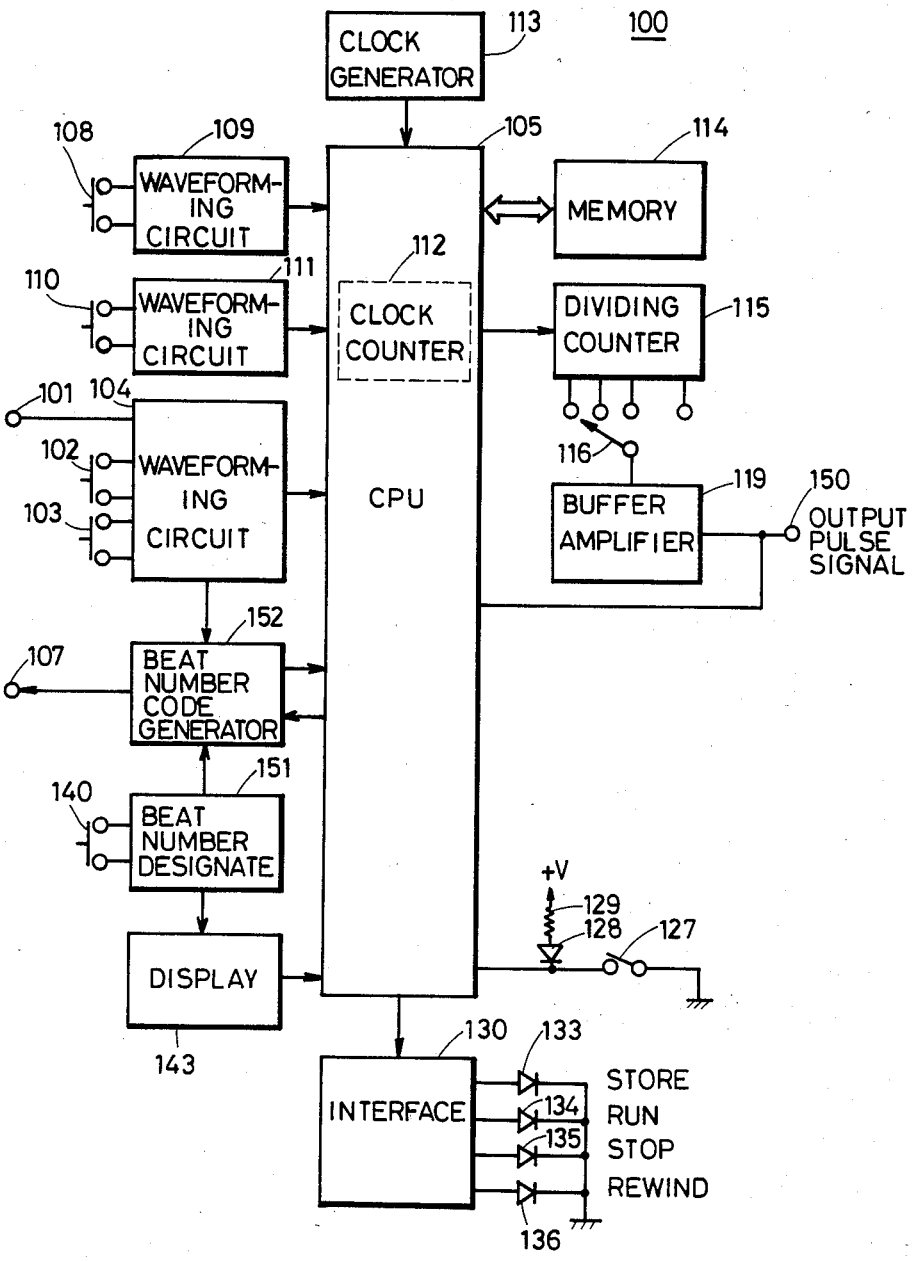
FIG. 6 is a schematic block diagram of another embodiment of the present invention.
Figure 7:
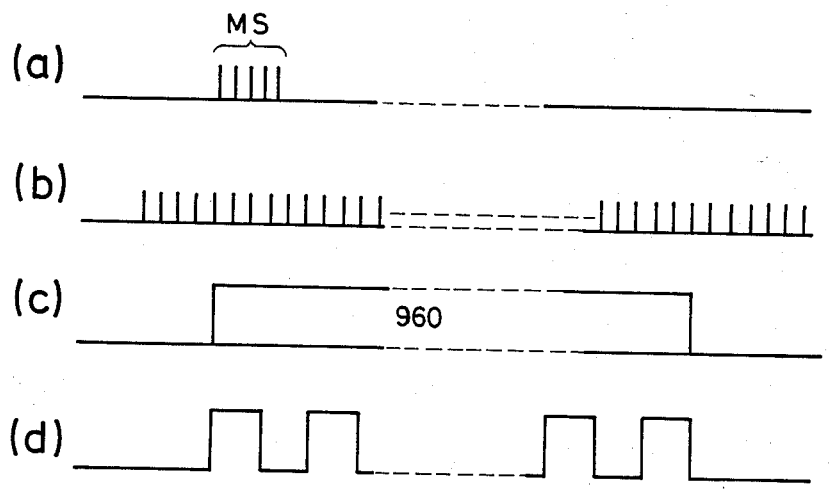
FIG. 7 is a waveform diagram of the signals in the components shown in FIG. 6.

The embodiment shown in FIG. 6 is the same as the previously described embodiment shown in FIG. 2 except that the retard switch 121, the advance switch 123, the AND circuits 122 and 124 and the NOR circuits 138 and 139 as shown in FIG. 2 are omitted and a beat number designating circuit 151 and a beat number code generating circuit 152 are provided instead of the measure number designating circuit 141 and the measure number code generating circuit 142.

Figure 8A:
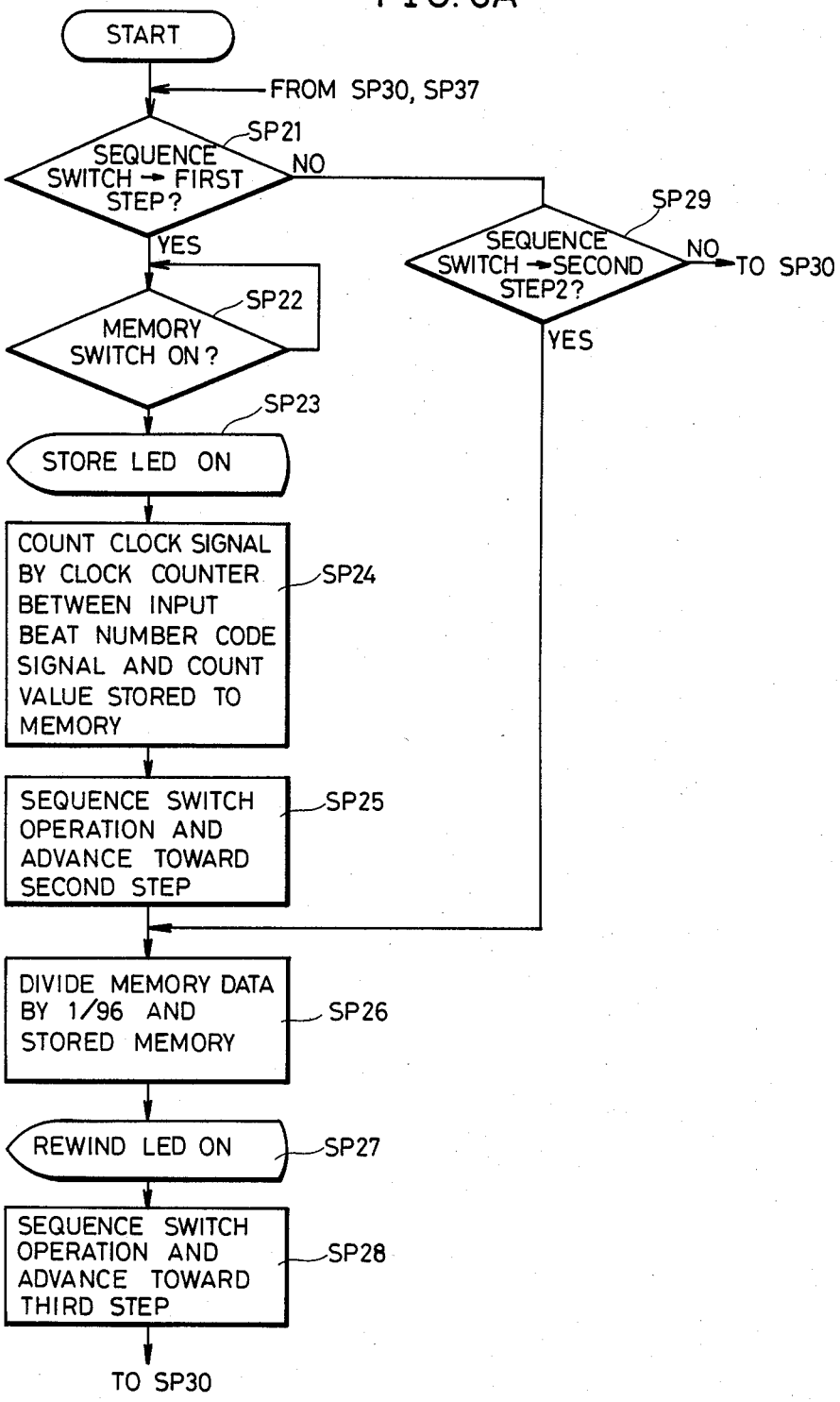
FIGS. 8A and 8B are flow charts for explaining the specific operation of another embodiment of the present invention.
Figure 8B:
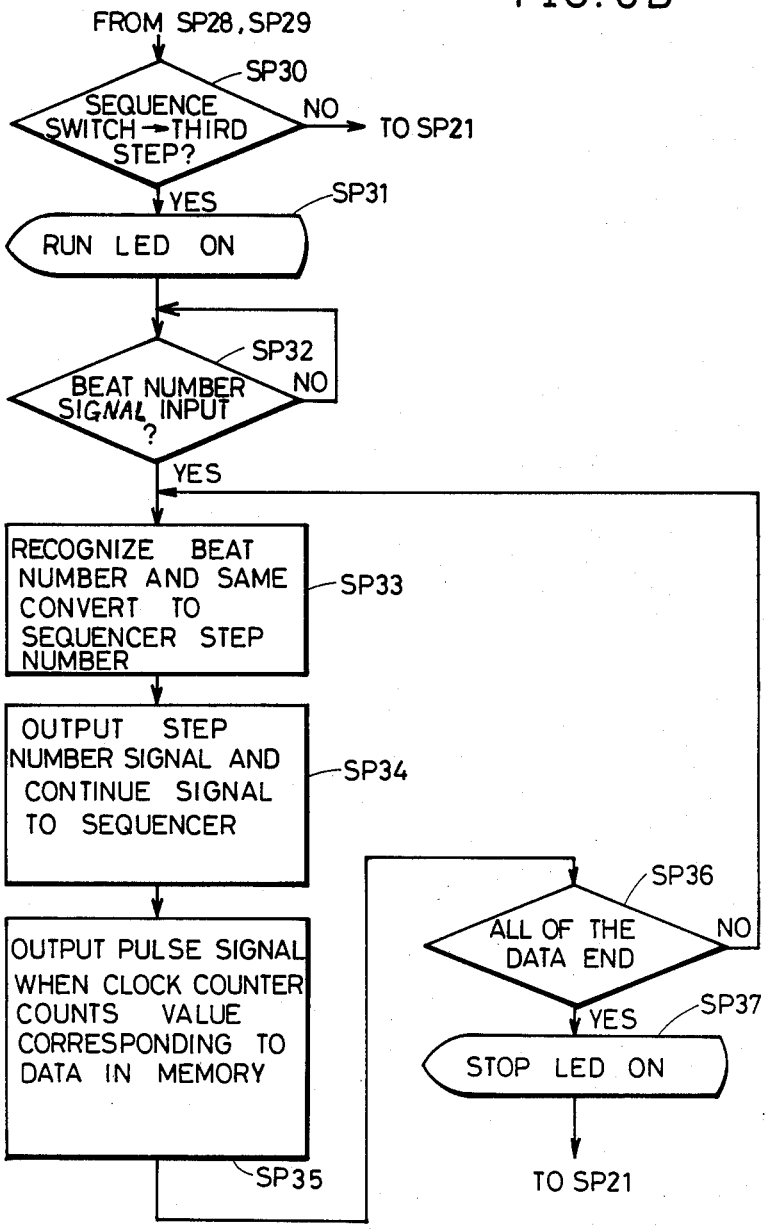

Now, referring to FIGS. 6, to 8B, the operation of this embodiment of the invention will be described.

First, the operation actuates the reset switch 108 and subsequently the sequence switch 110. After that, the memory loading switch 127 is turned ON. Using the ten key 140, the first beat is entered. Then, the display 143 indicates the first beat. The CPU 105 determines in step SP21 whether the first step is selected. If the first step is selected, it is determined in step SP22 whether the memory loading switch 127 is turned ON. If the memory loading switch 127 is turned ON, the CPU 105 turns on, in step 23, the light emitting diode 133 indicating "STORE".

In this state, the operator sets the tape deck 200 into record state and actuates the manual switch 102 or the foot switch 103 according to the musical sounds. In consequence, a code signal corresponding to the beat number of predetermined form provided by the beat number generating circuit 142 is fed to the first channel of the tape deck 200 through the beat number output terminal 107 so that it is recorded.

Subsequently, upon actuation of the manual switch 102 or the foot switch 103, beat number signals corresponding to the actuation are generated automatically from the beat number generator 142 and are recorded in the first channel of the tape deck 200.

The beat number signals are provided from the beat number output terminal 107 and at the same time received by the CPU 105. In response to the receipt of a particular one of the beat number signals, the CPU 105 supplies clock pulses generated from the clock oscillator 113 to the clock counter 112 to count the clock pulses during a length of time from the receipt of the particular beat number signal to the receipt of the succeeding beat number signal. A count value of the clock counter 112, for example, 960, is stored in the memory 114. Subsequently, in the same manner, count values of the clock counter 112 are successively stored in the memory 114 till the rhythm part is completed.

The count values stored in the memory 114 are interpolated with reference to by a cubic curve or a straight line, for example, so that the synchronizing signal output may change smoothly. In this embodiment, a straight line interpolation is applied.

Subsequently, when in step SP25, the operator actuates the sequence switch 110 to cause the CPU 105 to proceed to the second step, the CPU 105 turns on the light emitting diode 133 indicating "STORE". Then, the CPU 105 in step SP26 reads the above described count values from the memory 114 and divides the respective count values by a predetermined numerical value, for example, 96. Consequently, the CPU 105 reloads the memory 114 with a quotient resulting from the division, for example, 10. It means that straight line interpolation is applied between a beat number code signal and the succeeding beat number code signal.

The above described operations in the second step may be made during a period of time from the receipt of a particular beat number code signal to the receipt of the next succeeding beat number code signal.

When the sequential processing operations for all the count values are completed, the CPU 105 disables in step SP27 the light emitting diode 133 and turns on the light emitting diode 136 indicating "REWIND" so that the operator is informed to rewind the record tape. Then, the operator sets the tape deck 200 to rewind the tape and in step SP28, he actuates the sequence switch 110 so that the program proceeds to the third step. Consequently, the CPU 105 disables the light emitting diode 136 in step SP30 and turns on the light emitting diode 134 indicating "RUN" in step SP31. Looking at the display, the operator starts the tape deck 200 from an arbitrary position of the magnetic tape.

Subsequently, a beat number signal corresponding to the position where the reproduction of the tape deck 200 was started is fed from the tape deck 200 to the CPU 105 through the input terminal 101 and the waveforming circuit 104.

The CPU 105 determines in step SP32 whether a beat number signal is received or not and if received, the CPU identifies the beat number in step SP33 so that the identified beat number is converted into a corresponding step number of the sequencer 300. Then, in step SP34, the CPU 105 delivers a step number signal and a sequencer operation signal to the sequencer 300 so that the sequencer 300 is set to the step number. In addition, the CPU 105 delivers a sequencer restarting signal so that the sequencer 300 is placed in a condition where the sequencer 300 can be operated if a synchronizing signal is applied.

The CPU 105 in step SP35 starts the counter 112 for counting clock signals from the clock oscillator 113 after receipt of the beat number signal. When a count value of the clock counter 112 becomes equal to the numerical value stored in the memory 114 in the second step of the CPU 105, a signal is provided to reset the clock counter 112.

The CPU 105 delivers an output signal each time a count value of the clock counter 112 becomes equal to the numerical value stored in the memory 114 to reset the clock counter 112 and thus, this operation is repeated till the play is ended.

On the other hand, the signal delivered by the CPU 105 is supplied to the frequency dividing counter 115 for a frequency division at a predetermined division ratio. Then, any one of the outputs of the frequency dividing counter 115 is selected by the time base selector 116 so as to be supplied as synchronizing pulse signal through the buffer amplifier 119 and the output terminal 150. This synchronizing pulse signal is applied to the sequencer 300.

Since the sequencer 300 is caused to proceed to a predetermined sequence step through the above described operations, a play is started in synchronism with the synchronizing pulse signals.

Further, in step SP36, the CPU 105 determines that the above described sequential operations are completed and then in step SP37, it turns on the light emitting diode 135 indicating "STOP" to bring the sequential operations to an end.

If it is desired to start a synchronous play from an arbitrary point of a musical piece, the following operations are needed. Prior to the above described third step, the operator actuates the ten key 140 so that an arbitrary beat number, for example, the 18th beat of the musical piece is preset. Consequently, in the third step, the sequencer operation signal is outputted, the step of the sequencer 300 is caused to be the 18th beat and subsequently, a start signal for the sequencer is applied. When the tape deck 200 is caused to reproduce a pulse signal for a synchronous play is not supplied till the beat number identified by the CPU 105 becomes the 18th beat and therefore becomes equal to the output from the beat number generating circuit 142. Accordingly, the sequencer 300 starts a synchronous play from the 18th beat.

As signals for controlling the sequencer 300, MIDI (Musical Instrument Digital Interface) signals may be adopted. The MIDI signals are in conformity with the international standards which enable musical data to be transmitted by digital signals. More specifically, MIDI clock signals are utilized as output synchronizing signals and a song position pointer signal is utilized as a signal for enabling the sequencer to proceed to a predetermined step. In addition, an MIDI continuing signal is utilized as a signal for operating the sequencer when synchronizing signals are received. As a result, when a song position pointer signal is first supplied and subsequently, a continuing signal is supplied and then an MIDI clock signal is provided, the sequencer 300 starts a synchronous play from a step designated by the song position pointer signal.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A synchronizing signal generator comprising: code signal generating means for generating a code signal representing a position on the score of a musical piece in response to a manually entered instruction, said code signal generating means comprising position designating means for designating an absolute position on said score; and for producing a code signal representing said absolute position on said score as designated by said designating means for starting a synchronous performance from any arbitrarily selected position of a musical piece; said signal generator further comprising clock signal generating means for generating clock signals; counting means connected to an output terminal of said code signal generating means and to an output terminal of said clock signal generating means, by which an interval of application of the code signals is measured based on the clock signals from said clock signal generating means in response to application of the code signals from said code signal generating means; calculating means connected to an output terminal of said counting means for making a calculation based on a count output from said counting means and a predetermined calculation formula in response to an application of said count output; storage means connected to an output terminal of said calculating means for storing the result of said calculation in response to said calculation by said calculating means; and synchronizing signal output means connected to the output terminal of said calculating means for providing synchronizing signals based on the fact that said counting means counts the number of clock signals corresponding to the result of said calculation, in response to the fact that said calculating means reads the result of said calculation from said storage means.

2. The synchronizing signal generator in accordance with claim 1, further comprising a sequencer, wherein said synchronizing signal generator supplies synchronizing signals to said sequencer; said code signal generating means comprises beat number code signal generating means for generating a code signal representing a beat number corresponding to a step number of said sequencer as a code signal representing the position on said score; and said synchronizing signal generator further comprises: converting means connected to an output terminal of said beat number code signal generating means for converting the code signal into a signal representing a step number of said sequencer in response to the fact that the code signal representing said beat number is provided from said beat number code signal generating means; and means connected to an output terminal of said converting means for supplying a signal representing said converted step number to said sequencer.

3. The synchronizing signal generator in accordance with claim 1, wherein said calculating means comprises means for applying an interpolation to the intervals of the count values successively provided from said counting means, based on the output of said counting means and on a calculation formula of interpolation.

4. The synchronizing signal generator in accordance with claim 1, wherein said synchronizing signal output means comprises frequency dividing means for dividing said synchronizing signal and providing a signal resulting from the division.

5. The synchronizing signal generator in accordance with claim 4, wherein said frequency dividing means comprises output terminals for introducing a plurality of frequency division output signals having different division ratios, and said synchronizing signal generator further comprises selecting means connected to the output terminals of said frequency dividing means for selecting a frequency division signal provided from any one of the output terminals.

* * * * *

UNITED STATES PATENT AND TRADEMARK OFFICE

CERTIFICATE OF CORRECTION

PATENT NO. : 4,566,362

DATED : January 28, 1986

INVENTOR(S) : Tadao Kikumoto

It is certified that error appears in the above—identified patent and that said Letters Patent is hereby corrected as shown below:

Claim 1, column 11, line 20, after "and" insert --means--.

Signed and Sealed this

*Fifteenth* Day of *April 1986*

[SEAL]

*Attest:*

DONALD J. QUIGG

*Attesting Officer*

*Commissioner of Patents and Trademarks*